US006726080B2

(12) United States Patent
Hamada

(10) Patent No.: US 6,726,080 B2
(45) Date of Patent: Apr. 27, 2004

(54) NAILING MACHINE

(75) Inventor: Masao Hamada, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/227,420

(22) Filed: Aug. 26, 2002

(65) Prior Publication Data

US 2003/0052152 A1 Mar. 20, 2003

(30) Foreign Application Priority Data

Sep. 14, 2001 (JP) ..... 2001-279156

(51) Int. Cl.[7] ..... B26C 7/00
(52) U.S. Cl. ..... 227/120; 227/130; 173/169
(58) Field of Search ..... 227/8, 113, 120, 227/130; 173/168, 169, 218

(56) References Cited

U.S. PATENT DOCUMENTS 3,397,828 A * 8/1968 Volkman ..... 227/130
4,721,166 A * 1/1988 Clapp et al. ..... 173/177
4,750,568 A * 6/1988 Roxton et al. ..... 173/121
4,776,561 A * 10/1988 Braunlich et al. ..... 251/39
5,184,382 A * 2/1993 Ward et al. ..... 29/81.15
5,259,465 A * 11/1993 Mukoyama ..... 173/168
5,495,973 A * 3/1996 Ishizawa et al. ..... 227/8
5,637,125 A * 6/1997 Amada ..... 55/385.1
5,964,302 A * 10/1999 Lin ..... 173/169
6,149,356 A 11/2000 Chu et al.

FOREIGN PATENT DOCUMENTS

JP 7-112675 12/1995
TW 387318 4/2000

* cited by examiner

*Primary Examiner*—Scott A. Smith
*Assistant Examiner*—Nathaniel Chukwurah
(74) *Attorney, Agent, or Firm*—McDermott, Will & Emery

(57) ABSTRACT

A nailing machine comprises a machine body including a driving unit for driving a nail, a handle having an inner hollow portion formed as an accumulation chamber, the handle having one end mounted to the driving unit and another end to which a compressed air inlet port is formed, a filter disposed inside the accumulation chamber of the handle, and a nose portion mounted to the driving unit through which the nail is driven. The compressed air inlet port has an opening area smaller than a cross sectional area of an inner periphery of the handle, and the filter element is disposed in close contact to the compressed air inlet port.

6 Claims, 4 Drawing Sheets

NAILING MACHINE

BACKGROUND OF THE INVENTION

The present invention relates to a nailing machine for driving a nail by a compressed air supplied from a compressed air source through an air hose or like, the nailing machine being held, in operation, with a hand of an operator, and more particularly, to a nailing machine provided, inside thereof, with a filter member or element to prevent dust or like from entering inside.

As generally known, a nailing machine comprises power output unit provided with a handle which is held by an operator's hand and in which a driving unit for driving a piston is accommodated and a nose member which is disposed below the power output unit and through which nails are driven continuously.

In usual, such nailing machine is driven by the compressed air supplied from the compressed air source through an air hose, and in such operation, there may cause a case that impurities such as dust or like enter inside the nailing machine together with the compressed air and the entering impurities damage parts or elements of the nailing machine to thereby cause, in an adverse case, operation failure.

In order to obviate such problem as mentioned above, prior art provides an improved example having a structure provided with a filter member or element for preventing dust or like from entering, such as disclosed in the U.S. Pat. No. 5,259,465. In this publication, there is provided a pneumatic (air) nailing machine which has a handle in which a compressed air chamber is formed, and a filter member is disposed at a portion in the vicinity of a compressed air intake port formed inside the compressed air chamber. In such conventional nailing machine, impurities such as dust or like is prevented from entering inside the nailing machine over the location of the filter member disposed inside the handle.

However, in such conventional nailing machine, it is obliged to use a filter member having a large area substantially equal to a cross sectional area of the handle, and moreover, the filter member is clogged with the impurities. In a certain case, the impurities may be stayed in front of the filter member inside the handle, thus being inconvenient.

SUMMARY OF THE INVENTION

An object of the present invention is to substantially eliminate defects or drawbacks encountered in the prior art mentioned above and to provide a nailing machine provided with a filter having a small size and capable of effectively removing impurities clogging the filter net or impurities stayed in the nailing machine in front of the filter member.

This and other objects can be achieved according to the present invention by providing a nailing machine comprising:

- a machine body including a driving unit having a piston for driving a nail;
- a handle having a cylindrical shape having an inner hollow portion formed as an accumulation chamber, said handle having one end mounted to the driving unit and another end to which a compressed air inlet port is formed;
- a filter member disposed inside accumulation chamber of the handle;
- a nose portion mounted to the driving unit through which the nail is driven,
- the compressed air inlet having an opening area smaller than a cross sectional area of an inner periphery of the handle, and the filter member being disposed in close contact to the compressed air inlet port.

In a preferred embodiment of the above aspect, the compressed air inlet port is formed substantially in series to the handle. The filter member or element, preferably formed from a thin plate member, has an area larger than or substantially equal to the opening area of the compressed air inlet port. An air hose is mounted to the compressed air inlet port, through which a compressed air is introduced into the accumulation chamber formed to the handle.

According to the present invention of the structure mentioned above, a filter member having a small size can be effectively utilized. Impurities such as dust or like clogging the filter member or piled directly outside the compressed air inlet port can be effectively removed or discharged outside the machine body.

The nature and further characteristic features of the present invention will be made more clear from the following descriptions with reference to the accompanying drawings.

DESCRIPTION OF THE PREFERRED EMBODIMENTS

One embodiment of a nailing machine of the present invention will be described hereunder with reference to FIGS. 1 to 4.

Figure 1:
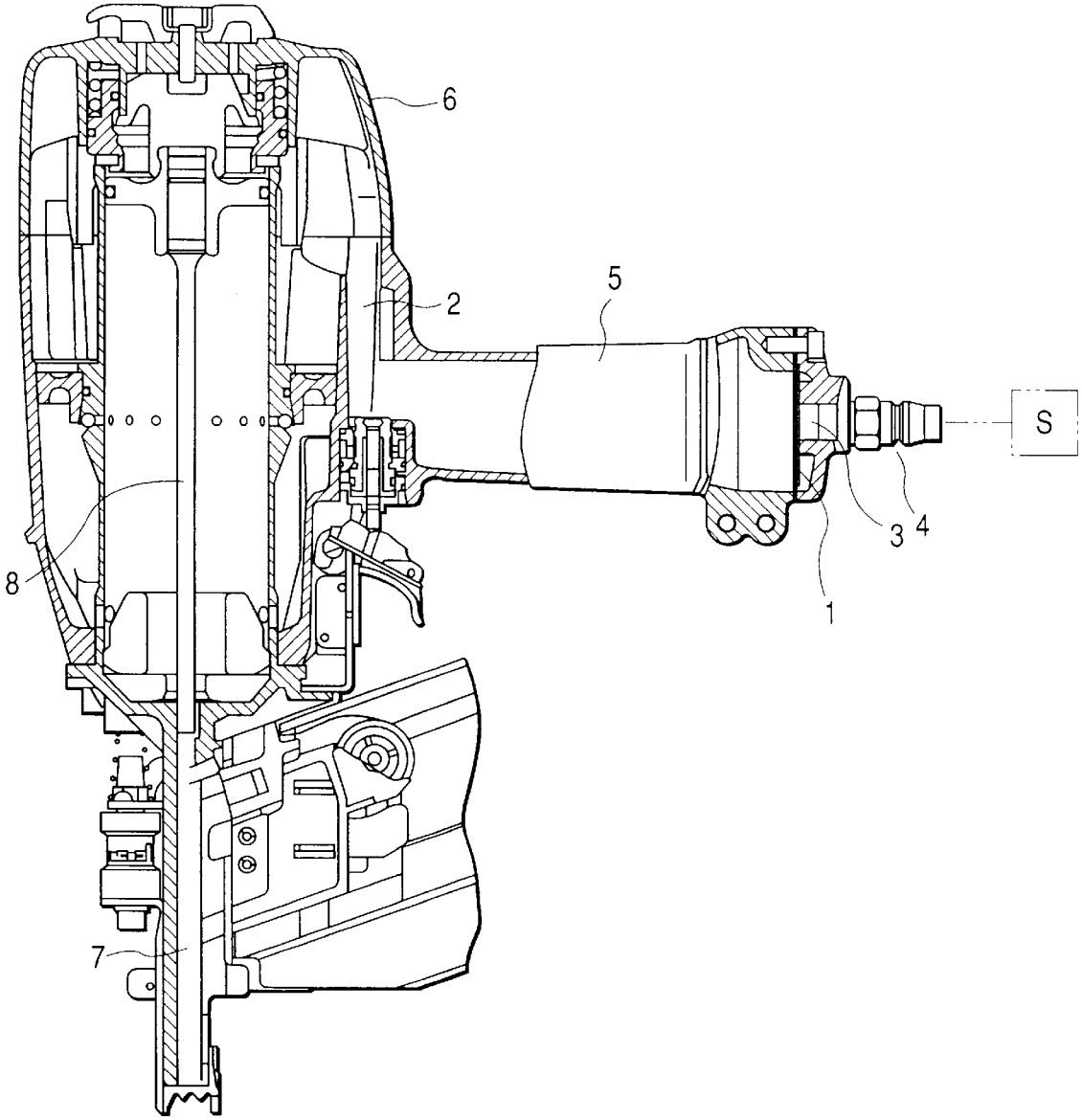
FIG. 1 is a side view, partially in section, of a nailing machine according to one embodiment of the present invention.

Referring to FIG. 1, the nailing machine comprises a machine body as a drive unit 6, a handle 5 which is mounted to the drive unit 6 and handled by a hand of an operator, and a nose portion 7 extending from the lower portion of the drive unit 6, the nose portion 7 being provided with an injection port through which nails are continuously driven.

The nailing machine is further provided, in the machine body, with an accumulation chamber 2 in which compressed air is stored and also provided with a piston 8 by which the nails are driven. The handle 5 has a cylindrical structure having an inner hollow space formed as the accumulation chamber 2.

Figure 2:
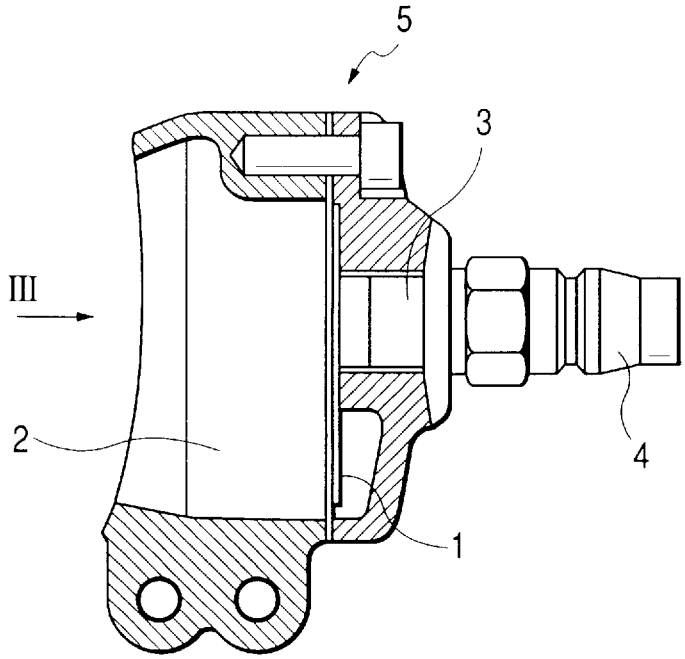
FIG. 2 is a sectional view of an essential portion, at which a filter member is disposed, of the nailing machine of the embodiment shown in FIG. 1.
Figure 3:
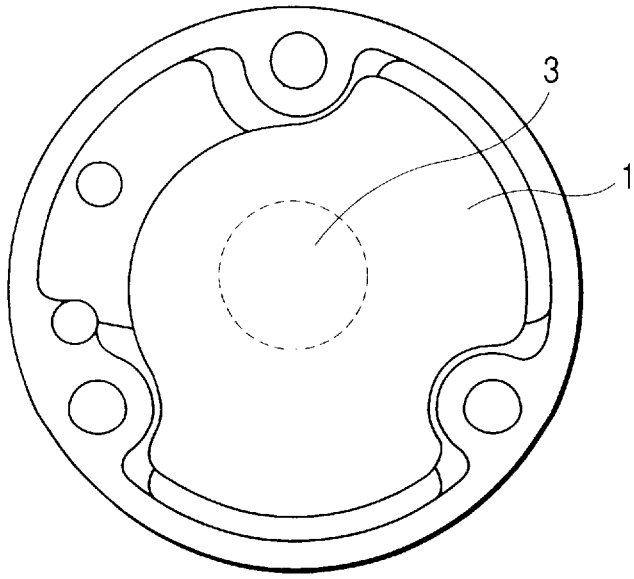
FIG. 3 is a plan view of the portion shown from the direction of III in FIG. 2.

With reference to FIGS. 2 and 3, the handle 5 has one end (operator's side) portion at which a compressed air inlet port 3 is formed, and this compressed air inlet port 3 is formed so as to have a sectional area smaller than that of the handle 5.

Figure 4:
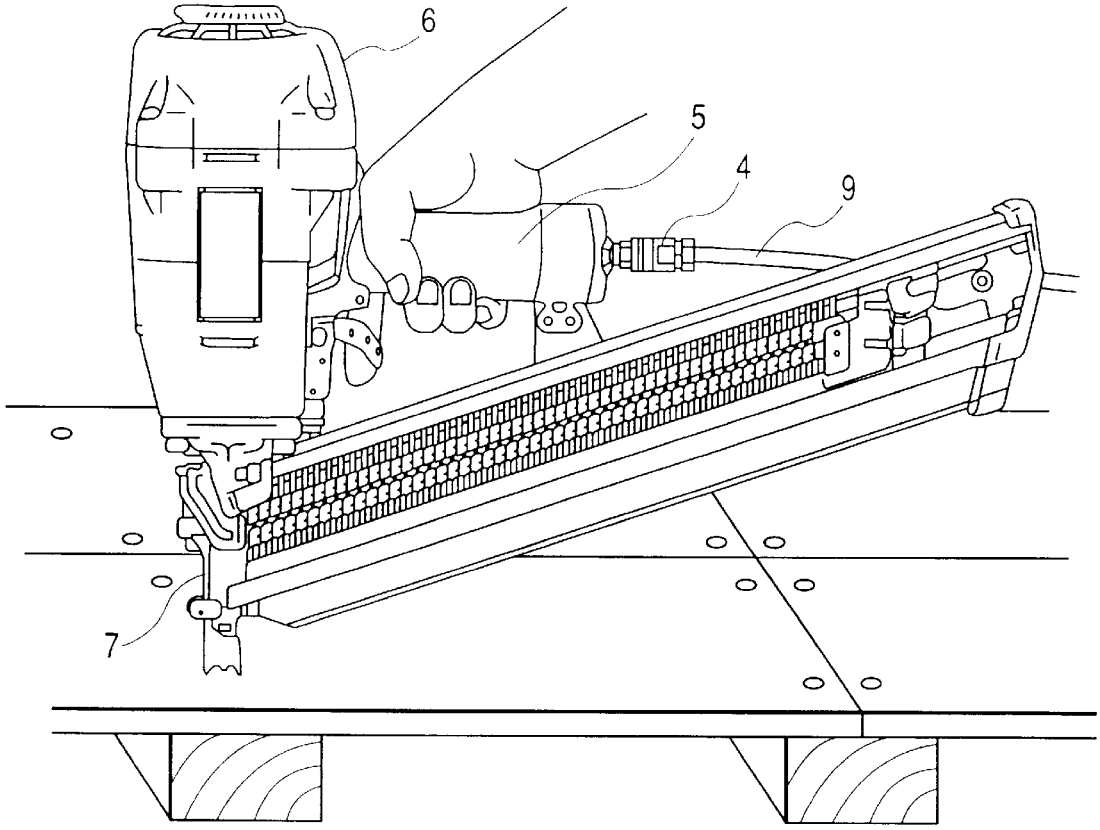
FIG. 4 is a perspective view of the nailing machine of the embodiment of FIG. 1 in a using state thereof.

A filter member 1 is disposed in the handle 5 at the compressed air inlet port 3, to which an air hose 9 is connected by means of plug 4. The filter member 1 will be preferably formed from compressed plastic fiber or wire mesh. In an actual nail driving operation, as shown in FIG. 4, the nailing machine held by a hand of an operator is driven by the compressed air supplied from an external compressed air source S through the air hose 9 and the compressed air inlet port 3. In the illustrated state, when the drive unit 6 is operated, nails are continuously driven through the nail injection port formed to the nose portion 7.

The filter member 1 is disposed, as shown in FIG. 2, at the compressed air inlet side end portion of the handle 5 so as to prevent the impurities such as dust and the like from entering inside the nailing machine body. The air filter member 1 is tightly secured to the compressed air inlet port 3, thus effectively filtrating the impurities before the entering into the accumulation chamber 2 of the nailing machine.

Further, more in detail, the filter member 1 is disposed in tight contact to the compressed air inlet port 3 in the following technology.

Figure 6A:
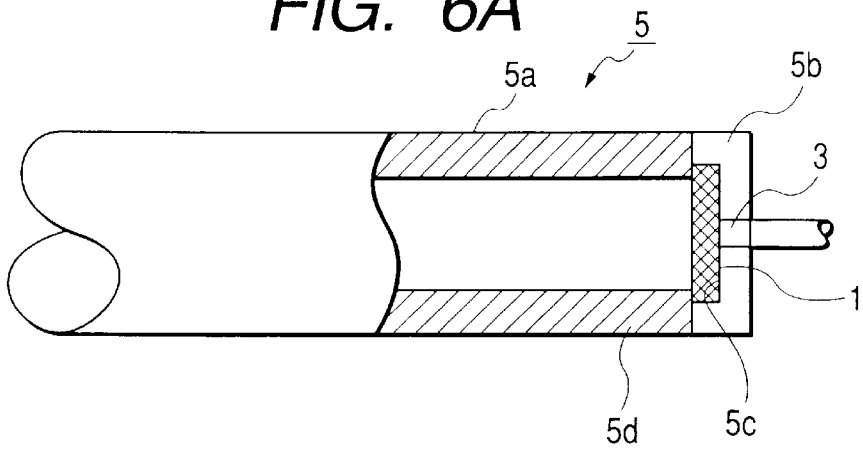
FIGS. 6A to 6*c* are illustrations showing examples of mounting the filter member to the handle of the nailing machine.
Figure 6B:
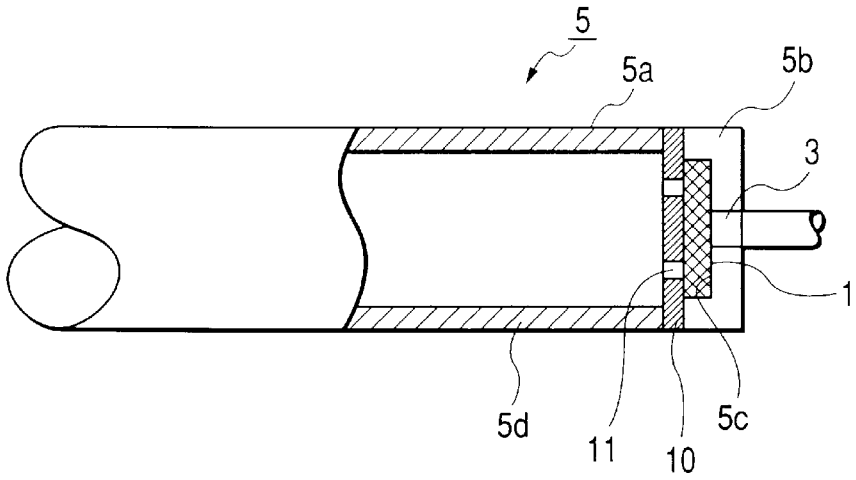
Figure 6C:
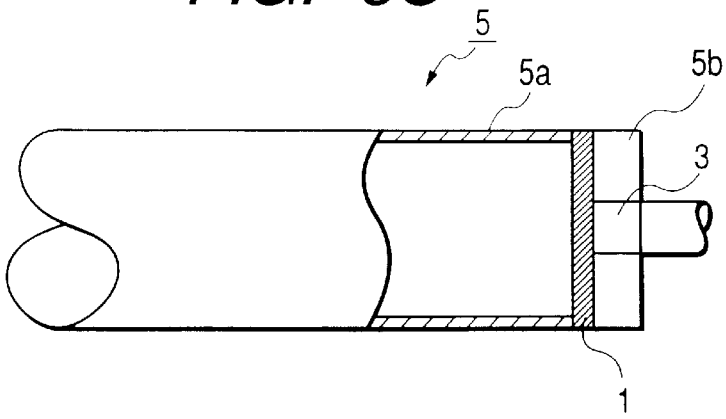

That is, with reference to the illustrations of FIGS. 6A to 6C, showing examples of mounting the filter member 1 to the handle 5, the handle 5 comprises a handle body 5*a* and an end member 5*b* closing one opened end of the cylindrical handle body 5*a*.

In one example illustrated in FIG. 6A, the end member 5*b* formed separately from the handle body 5*a* is provided with an inner recess 5*c* communicating with the compressed air inlet port 3 formed to the end member 5*b*, the recess 5*c* having a depth and shape corresponding to the thickness and the outer shape of the filter member 1. When the end member 5*b* is mounted to the opened end of the handle body 5*a*, the filter member 1 is fitted into the recess 5*c* of the end member 5*b*. The filter member 1 fitted into this recess is fixed by, for example, a projection 5*d* formed inside the handle body 5*a* so as not to move the filter member 1 in the recess.

In a more preferred example of FIG. 6B, a packing 10 may be disposed between the handle body 5*a* and the end member 5*b* thereof, or projection 5*d* of the handle body and the of end member 5*b*. The packing 10 is in form of film or like formed with a hole or holes 11 through which air passes. In the above examples, the end member 5*b* will be fixed to the handle body 5*a* by means of screws or bolts, not shown, but as shown in FIG. 2, for example, in an air-tight manner.

Further, as shown in FIG. 6C, the filter member 1 may be disposed between the handle body 5*a* provided with no projection and the end member 5*b* without forming any recess such as mentioned above. In this example, the filter member 1 is tightly interposed between the cylindrical handle body 5*a* and the end member 5*b* and fixed thereto by means of screws or bolts in an air-tight manner so that the air does not leak through the mating portion thereof.

Further, it may be considered that the filter member 1 is clogged for the long time use thereof and the impurities may be piled in front of the filter member 1, external side of the handle 5. However, such impurities will be effectively and surely discharged and removed outside the nailing machine at the time of removing the air hose 9, after the use of the nailing machine, because the compressed air inside the machine flows directly towards the filter member 1 and is violently discharged through the inlet port 3.

Figure 5:
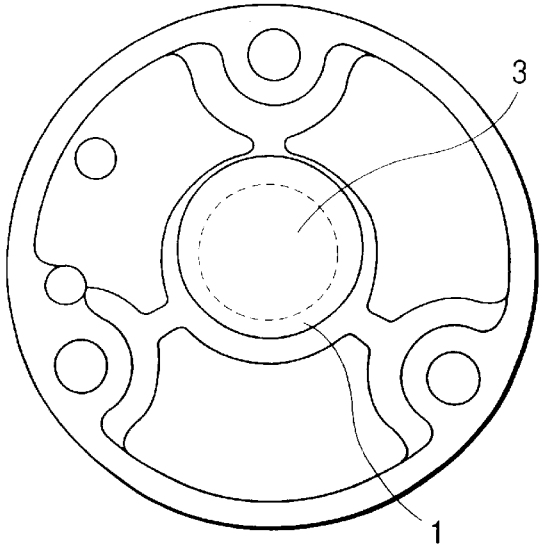
FIG. 5 is a view similar to that shown in FIG. 2 but showing another embodiment of the present invention.

Further, although, in the embodiment illustrated in FIG. 3, the filter member 1 has an area larger than the opening area of the compressed air inlet port 3, as shown in FIG. 5, the filter member 1 may have substantially the same area as that of the compressed air inlet port 3, and in such embodiment, like advantageous effect will be achieved.

What is claimed is:

1. A nailing machine comprising:

a machine body including a driving unit having a piston for driving a nail;

a handle having a cylindrical shape having an inner hollow portion formed as an accumulation chamber, said handle having one end mounted to the driving unit and another end to which a compressed air inlet port is formed;

a filter member having a thin plate structure, which is disposed inside the accumulation chamber of the handle so as to be in close contact to the compressed air inlet port, said filter member having an area substantially equal to the opening area of the compressed air inlet port; and a nose portion mounted to the driving unit through which the nail is driven.

2. A nailing machine according to claim 1, wherein said compressed air inlet port is formed substantially in series to the handle.

3. A nailing machine according to claim 1, further comprising an air hose mounted to the compressed air inlet port through which a compressed air is introduced into the accumulation chamber formed to the handle.

4. A nailing machine comprising:

a machine body including a driving unit having a piston for driving a nail;

a handle having a cylindrical shape having an inner hollow portion formed as an accumulation chamber, said handle having one end mounted to the driving unit and another end to which an end member, to which a compressed air inlet port is formed, is mounted, said end member having an inward recessed portion opened to the accumulation chamber of the handle;

a filter member disposed in said recessed portion of the end member in contact to the compressed air inlet port;

a packing member, having an air permeable structure, disposed between said another end of the handle and said end member in contact to the opening of the recessed portion; and a nose portion mounted to the driving unit through which the nail is driven.

5. A nailing machine according to claim 4, said packing is provided with a perforation through which the compressed air passes.

6. A nailing machine according to claim 4, wherein said recessed portion has a size and a depth corresponding to an outer shape and a thickness of the filter member to be disposed therein.

* * * * *